US005517166A

United States Patent [19]

Bollen

[11] Patent Number: 5,517,166

[45] Date of Patent: May 14, 1996

[54] MERCURY WETTED SWITCH

[75] Inventor: Romain F. Bollen, Hasselt, Belgium

[73] Assignee: C. P. Clare International N.V., Tongeren, Belgium

[21] Appl. No.: 302,734

[22] PCT Filed: Oct. 20, 1992

[86] PCT No.: PCT/BE92/00044

§ 371 Date: Aug. 30, 1994

§ 102(e) Date: Aug. 30, 1994

[87] PCT Pub. No.: WO94/09501

PCT Pub. Date: Apr. 28, 1994

[51] Int. Cl.[6] ..... H01H 1/08

[52] U.S. Cl. ..... 335/58; 335/60

[58] Field of Search ..... 335/58–62

[56] References Cited

U.S. PATENT DOCUMENTS

| | | | |
|---|---|---|---|
| 3,482,071 | 12/1969 | Miller | 335/58 |
| 4,134,088 | 1/1979 | Asbell et al. | 335/58 |
| 4,260,970 | 4/1981 | Bitko | 335/58 |

FOREIGN PATENT DOCUMENTS

| | | |
|---|---|---|
| 1173162 | 7/1964 | Germany . |
| 1514689 | 6/1969 | Germany . |
| 2226573 | 12/1973 | Germany . |
| 9002409 | 3/1990 | WIPO . |

*Primary Examiner*—Lincoln Donovan
*Attorney, Agent, or Firm*—Merchant, Gould, Smith, Edell, Welter & Schmidt

[57] ABSTRACT

A switch assembly comprising a housing including a baseplate on which are mounted a magnetic core having a pair of flanges and a winding wound around it, and two switch capsules positioned on either sides of the magnetic core with each capsule being insulated from each flange of the magnetic core by insulating means. Magnets are also positioned to provide either a monostable or a bistable mode of operation as desired. With this constructions, the magnetic and electric paths in the assembly are physically separate from one another, thereby allowing the magnetic and electric materials to be chosen independently from each other.

5 Claims, 2 Drawing Sheets

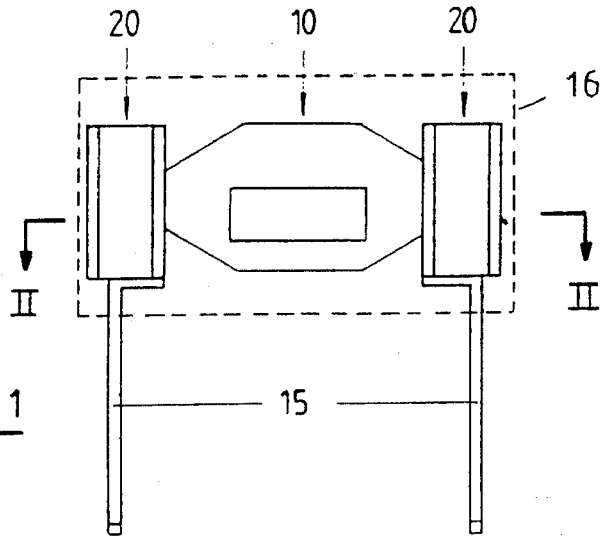
FIG. 1
FIG. 2
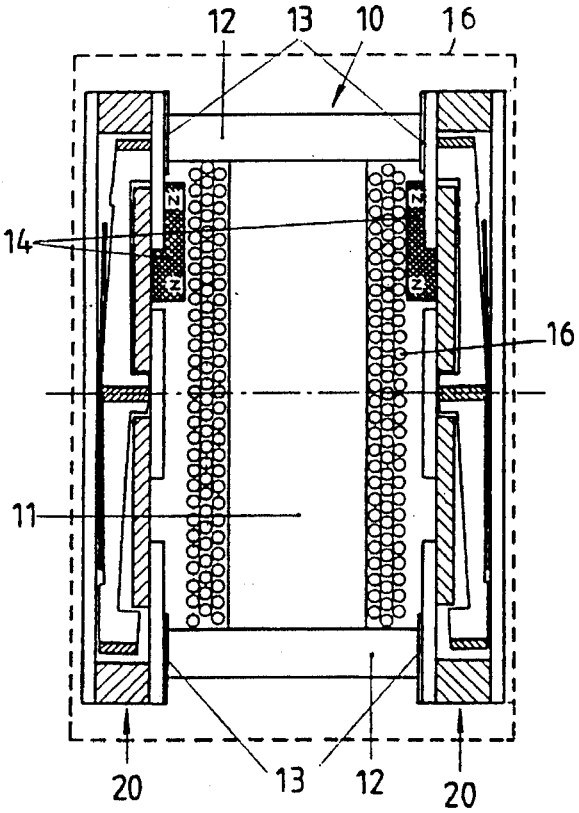
FIG. 3
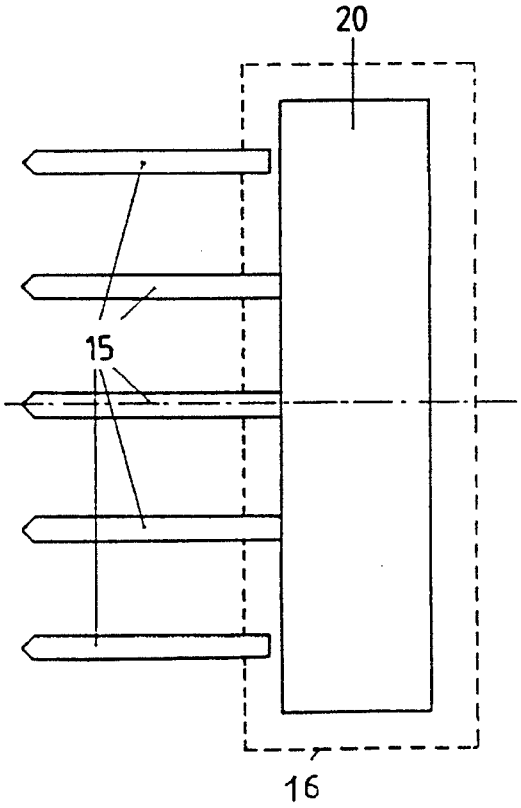

MERCURY WETTED SWITCH

FIELD OF THE INVENTION

The present invention relates to a mercury wetted switch assembly which is capable of operation in any position.

BACKGROUND OF THE INVENTION

A typical mercury wetted switch comprises a sealed glass capsule in which there is mounted a movable armature having a pair of pole ends for alternately contacting a respective electric contact when the armature is pivoting and the surface of the armature is wetted with a film of mercury. An energizing coil is provided to generate magnetic field in the magnetic conducting parts in order to generate a magnetic force which tends to operate the switch. The mode of operation, either monostable or bistable, is creating by externally positioning one or two permanent magnets to the capsule.

The reeds used in the capsule for making the switching contacts are to be made of a material that must be carefully chosen in order to meet three requirements:

1) it must be optimally magnetic conducting,
2) it must be optimally electric conducting,
3) it must have an expansion coefficient that is compatible with that of glass.

In practice, the choice of the material for the reeds is a compromise between the said three requirements and can never optimally meet all and each of them.

SUMMARY OF THE INVENTION

The object of this invention is to provide a mercury wetted switch construction in which the magnetic and electric paths are as much as possible separate from each other thereby allowing the magnetic and electric materials to be optimally chosen independently from one another.

It is another object of this invention to provide a mercury wetted switch construction in which the magnetic and electric paths are as much as possible separate from each other thereby making it possible to achieve better magnetic and electrical characteristics.

These objects are attained in accordance with the invention with a mercury wetted switch assembly as defined in the claims.

In particular, there is provided a switch assembly comprising a housing including a baseplate. On the baseplate are mounted a magnetic core having a pair of flanges and a winding wound around it, and two switch capsules positioned on either sides of the magnetic core with each capsule being insulated from each flange of the magnetic core by insulating means. Magnets are also positioned to provide either a monostable or a bistable mode of operation as desired. With this construction, the magnetic and electric paths in the assembly are physically separated from one another, thereby allowing the magnetic and electric materials to be chosen independently from each other.

BRIEF DESCRIPTION OF THE DRAWINGS

FIG. 1 is a front view of an exemplary embodiment of the switch assembly in accordance with the invention.

FIG. 2 is a cross-sectional view along line II—II in FIG. 1.

FIG. 3 is a side view of tile switch assembly of FIG. 1.

DESCRIPTION OF AN EXEMPLARY EMBODIMENT

Figure 4:
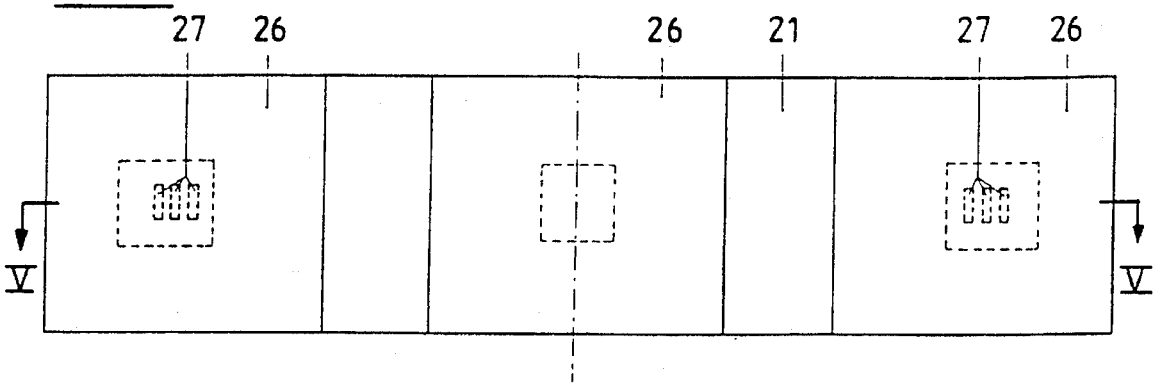
FIG. 4 is a bottom view of one of the capsules shown in FIG. 1.

Referring to FIGS. 1 and 2 it is shown that the switch assembly according to the invention essentially comprises a magnetic unit 10 and two switch capsules 20 which are mounted on either sides of the magnetic unit 10. The whole assembly is housed in an envelope or housing 16 with terminals 15 projecting therefrom.

The magnetic unit 10 includes a I-shaped magnetic core 11 having a winding 17 directly wound around it and end flanges 12 made of the same magnetic material. Each switch capsule 20 is insulated from the flanges 12 of the magnetic core by means of insulating tapes 13 (FIG. 2) whereby the magnetic and electric paths are physically separated from each other. This construction allows the magnetic and electric conducting materials to be optimally chosen independently from one another.

Figure 5:
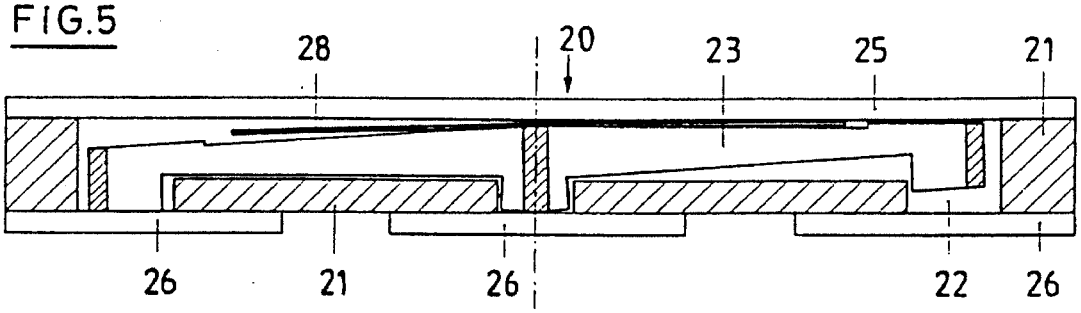
FIG. 5 is a cross-sectional view along line V—V in FIG. 4.
Figure 6:
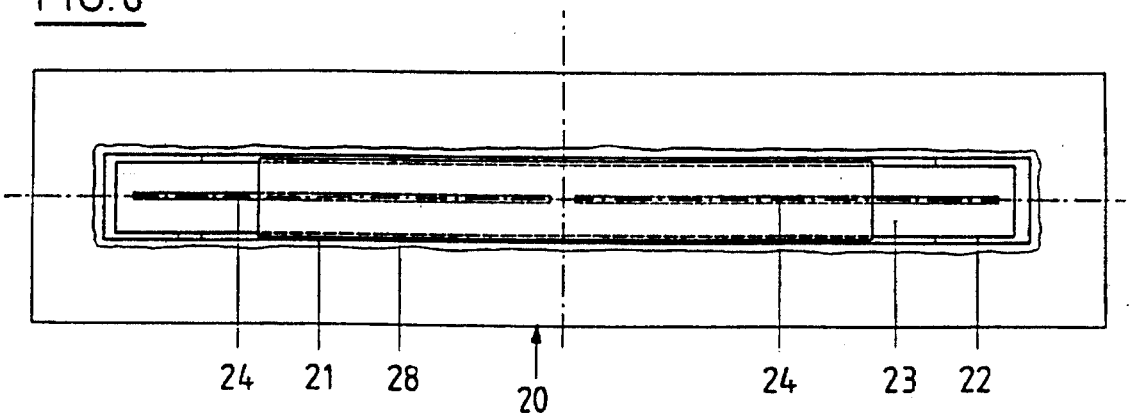
FIG. 6 is a partially stripped view of a capsule shown in FIG. 1.

Each switch capsule 20 is arranged as shown in FIGS. 4, 5 and 6. The capsule comprises a ceramic plate 21 having a recess 22 formed therein for accommodation of a cantilever beam 23 in such a manner that it is capable of pivoting movement with a minimum clearance between the beam and the ceramic plate. The beam 23 has a pair of pole ends for alternately contacting a respective electric contact when the beam is pivoting. A spring 28 is positioned on the cantilever beam 23 in order to centering the beam 23 within the ceramic housing and also to apply a high acceptable return force when a contact is caused to break. The surface of the cantilever beam 23 is wetted with a film of mercury. This construction is effective to prevent an excess of mercury to be splashed onto the ceramic surfaces thereabout whereby greater switching reliability is secured.

The ceramic plate 21 is surrounded with metal foils: an upper metal foil 25 on the top surface and three spaced apart contacting foils 26 on the opposite surface. The inner side of the two outer contacting foils 26 are provided with at least three mercury-wetted elongated contact spots 27. Simultaneous contacts can be arranged thereby making it possible to switch very high load currents.

The cantilever beam 23 has a lengthwise extending capillary groove 24 formed therein for allowing mercury to be distributed to the switching areas. The terminals 15 are directly connected to the capsules 20 whereby these terminals are physically independent from the winding construction.

A magnet 14 is externally positioned to each capsule 20 thereby to provide a normal magnetic make position of the switch. Providing two magnets on the capsules makes it possible to secure a bistable mode of operation which requires a magnetic balance in the system.

I claim:

1. A mercury-wetted switch assembly, comprising:

a housing;

a baseplate inside the housing;

a winding construction including a magnetic core mounted on the baseplate and having a pair of end flanges, and a winding wound directly around said core;

a pair of mercury-wetted switch capsules mounted on the baseplate with one capsule being positioned on either side of the magnetic core, each capsule being insulated from each of the flanges of the magnetic core by insulating means;

at least one of said capsules having at least one magnet externally positioned to the capsule; and each of said capsules having terminals connected directly to the capsule and projecting from the housing, whereby said terminals are physically independent from the winding construction.

2. A switch assembly as claimed in claim 1, wherein each of the switch capsules includes a ceramic plate having a recess formed therein for accommodation of a cantilever beam mounted such that said beam is capable of pivoting movement, said beam having a pair of pole ends for alternately contacting a respective electric contact when the beam is pivoting, a surface of said beam being wetted with a film of mercury.

3. A switch assembly as claimed in claim 2, wherein the pole ends of the cantilever beam are provided with mercury-wetted contact spots.

4. A switch assembly as claimed in claim 2, wherein the cantilever beam is provided with a lengthwise groove for allowing distribution of mercury to the switching areas.

5. A switch assembly as claimed in claim 4, wherein the pole ends of the cantilever beam are provided with mercury-wetted contact spots.

* * * * *